US011369173B2

(12) United States Patent
Johnson

(10) Patent No.: US 11,369,173 B2
(45) Date of Patent: Jun. 28, 2022

(54) SUITCASE WITH INTEGRATED GARMENT BAG

(71) Applicant: Ivory Johnson, Hutchins, TX (US)

(72) Inventor: Ivory Johnson, Hutchins, TX (US)

( * ) Notice: Subject to any disclaimer, the term of this patent is extended or adjusted under 35 U.S.C. 154(b) by 420 days.

(21) Appl. No.: 16/376,030

(22) Filed: Apr. 5, 2019

(65) Prior Publication Data

US 2019/0231046 A1 Aug. 1, 2019

Related U.S. Application Data

(62) Division of application No. 13/797,842, filed on Mar. 12, 2013, now Pat. No. 10,258,126.

(60) Provisional application No. 61/694,173, filed on Aug. 28, 2012.

(51) Int. Cl.

| | |
|---|---|
| ***A45C 13/00*** | (2006.01) |
| ***A45C 5/14*** | (2006.01) |
| ***A45C 9/00*** | (2006.01) |
| ***A45C 13/03*** | (2006.01) |
| ***A45C 13/28*** | (2006.01) |

(52) U.S. Cl.

CPC ..... *A45C 13/001* (2013.01); *A45C 5/14* (2013.01); *A45C 9/00* (2013.01); *A45C 13/03* (2013.01); *A45C 13/28* (2013.01)

(58) Field of Classification Search

CPC ..... A45C 13/001; A45C 5/14; A45C 9/00; A45C 13/03; A45C 13/28

See application file for complete search history.

(56) References Cited

U.S. PATENT DOCUMENTS

| | | | | |
|---|---|---|---|---|
| 901,636 | A * | 10/1908 | McIntire | F16M 7/00 |
| 1,611,584 | A * | 12/1926 | Farkash et al. | A47G 25/54 206/287 |
| 1,818,525 | A * | 8/1931 | Perez | A47B 61/06 190/3 |
| 2,732,270 | A * | 1/1956 | Bily | A47G 25/54 312/3 |
| 3,958,675 | A | 5/1976 | Rosenblum | |
| 3,963,102 | A | 5/1976 | Carp | |
| 4,098,312 | A | 7/1978 | Mcalin | |
| 4,189,035 | A | 2/1980 | Herz | |
| 4,738,340 | A | 4/1988 | Crespi | |
| 4,817,791 | A | 4/1989 | Adams | |
| 4,854,431 | A | 8/1989 | Pulichino | |
| 5,096,275 | A * | 3/1992 | Pappas | A47B 51/00 312/312 |
| 6,305,587 | B1 | 10/2001 | Miller | |
| 6,851,770 | B2 * | 2/2005 | Canedy | A47F 3/002 312/114 |

(Continued)

FOREIGN PATENT DOCUMENTS

| | | |
|---|---|---|
| EP | 0 132 016 B1 | 4/1989 |
| EP | 0 900 031 B1 | 5/2003 |

OTHER PUBLICATIONS www.skyroll.com,skyroll carry on luggage.
http://shop.samsonite.com/db/Booatd3tdtd8,samsonite silhouette sphere spinner garment bag.

*Primary Examiner* — Tri M Mai

(74) *Attorney, Agent, or Firm* — Haverstock & Owens, A Law Corporation

(57) ABSTRACT

A suitcase with an integrated garment bag is able to be used to neatly store items to prevent them from being wrinkled or otherwise disarranged.

16 Claims, 8 Drawing Sheets

(56) References Cited

U.S. PATENT DOCUMENTS

| | | | | |
|---|---|---|---|---|
| 8,414,093 | B2 * | 4/2013 | Moran | A47B 51/00<br>312/248 |
| 2006/0045677 | A1 * | 3/2006 | Garfield | A45C 13/385<br>414/340 |
| 2007/0295570 | A1 | 12/2007 | Campbell | |
| 2009/0102340 | A1 * | 4/2009 | Wenzel | A47B 88/457<br>312/334.1 |

* cited by examiner

SUITCASE WITH INTEGRATED GARMENT BAG

CROSS-REFERENCE TO RELATED APPLICATION(S)

This application is a divisional application of U.S. patent application Ser. No. 13/797,842, filed Mar. 12, 2013, and titled "SUITCASE WITH INTEGRATED GARMENT BAG," which claims priority under 35 U.S.C. § 119(e) of the U.S. Provisional Patent Application Ser. No. 61/694,173, filed Aug. 28, 2012, and titled "SUITCASE WITH INTEGRATED GARMENT BAG," which are all hereby incorporated by reference in its entirety for all purposes.

FIELD OF THE INVENTION

The present invention relates to the field of luggage. More specifically, the present invention relates to integrated suitcases.

BACKGROUND OF THE INVENTION

Luggage is typically structured as a cuboid with a single open space within for storing items such as clothes. Some luggage includes pockets coupled to the cuboid for storing small items. However, the open space in standard luggage does not provide any protection from wrinkling of the clothes. Additionally, standard luggage requires a user to lay the luggage on the floor or bed to retrieve clothing from the suitcase which can be inconvenient.

SUMMARY OF THE INVENTION

A suitcase with an integrated garment bag is able to be used to neatly store items to prevent them from being wrinkled or otherwise disarranged.

In one aspect, a device comprises a frame, a partition within the frame separating the frame into a plurality of chambers and a garment bag stored in a chamber of the plurality of chambers. The device further comprises a handle coupled to the partition for lifting the partition substantially out of the frame. The garment bag is coupled to the partition. The garment bag further comprises doors selected from the group consisting of French doors and suicide doors. The device further comprises a drawer contained within the frame at the bottom of the frame. The device further comprises extendable stabilization feet. The device further comprises a backdoor within the frame for accessing the garment bag while the garment bag is still within the frame. The device further comprises a locking mechanism for locking the garment bag within the frame.

In another aspect, a device comprises a frame, a partition within the frame separating the frame into a plurality of chambers, a garment bag stored in a chamber of the plurality of chambers and a motorized component coupled to the garment bag for moving the garment bag. The device further comprises a handle coupled to the partition for lifting the partition substantially out of the frame. The garment bag is coupled to the partition. The device further comprises a drawer contained within the frame at the bottom of the frame. The device further comprises extendable stabilization feet. The motorized component includes a telescoping arm for raising and lowering the garment bag. The device further comprises a mobile device for controlling the motorized component. The mobile device is a remote control or a smart phone. The device further comprises tracks for moving the garment bag. The device further comprises a backdoor within the frame for accessing the garment bag while the garment bag is still within the frame. The device further comprises a locking mechanism for locking the garment bag within the frame.

In another aspect, a method of utilizing a suitcase with an integrated garment bag comprises removing the garment bag from the suitcase using a motorized component affected by a wireless device, inserting garments into the garment bag, returning the garment bag to the suitcase using the motorized component affected by the wireless device and using the suitcase as luggage.

In another aspect, suitcase comprises a frame, a partition within the frame separating the frame into a plurality of chambers, wherein a first chamber of the plurality of chambers is configured for storing items, a garment bag stored in a second chamber of the plurality of chambers, wherein the garment bag is configured for storing garments to minimize the wrinkling of the garments, a locking mechanism located within the frame configured for locking the garment bag within the frame, tracks located within the frame on which the garment bag is movable, a motorized component including a telescoping arm configured for raising and lowering the garment bag, a drawer contained within the frame at the bottom of the frame, a plurality of extendable stabilization feet coupled to the frame and a backdoor within the frame for accessing the garment bag while the garment bag is still within the frame.

DETAILED DESCRIPTION OF THE PREFERRED EMBODIMENT

A suitcase within an integrated garment bag enables a user to store items the user wishes to keep unwrinkled or otherwise protected from other items in the suitcase. The suitcase is able to be a non-carry on suitcase or a carry on suitcase.

The garment bag is typically non-removable, although, in some embodiments, the garment bag is removable.

Figure 1:
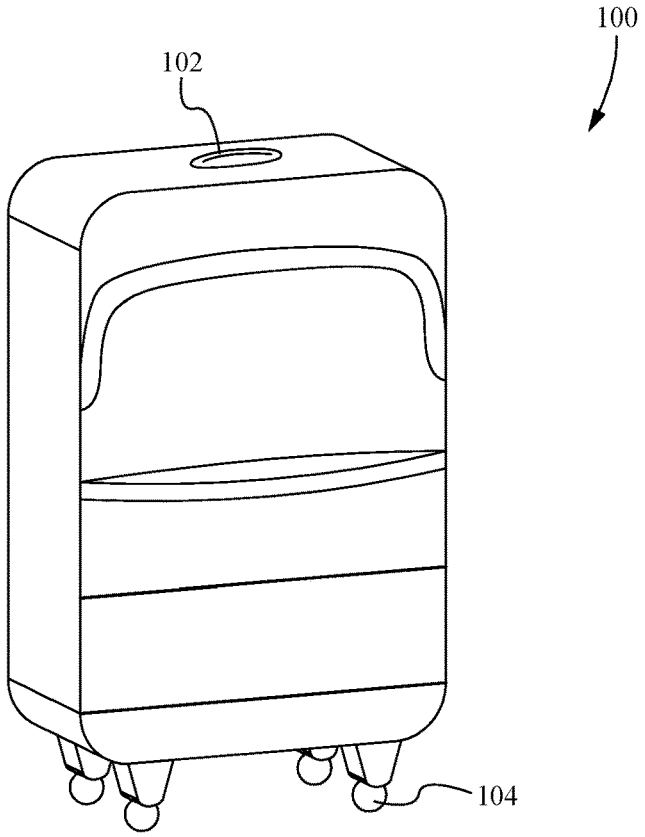
FIG. 1 illustrates a perspective view of a suitcase with an integrated garment bag according to some embodiments.

FIG. 1 illustrates a perspective view of a suitcase with an integrated garment bag according to some embodiments. The suitcase 100 appears the same as or similar to a standard suitcase. Although a specific shape and size is shown, the suitcase 100 is able to be any appropriate shape and/or size. The suitcase 100 is able to have a handle 102, wheels/rollers 104 and/or any other standard luggage component or accessory.

Figure 2:
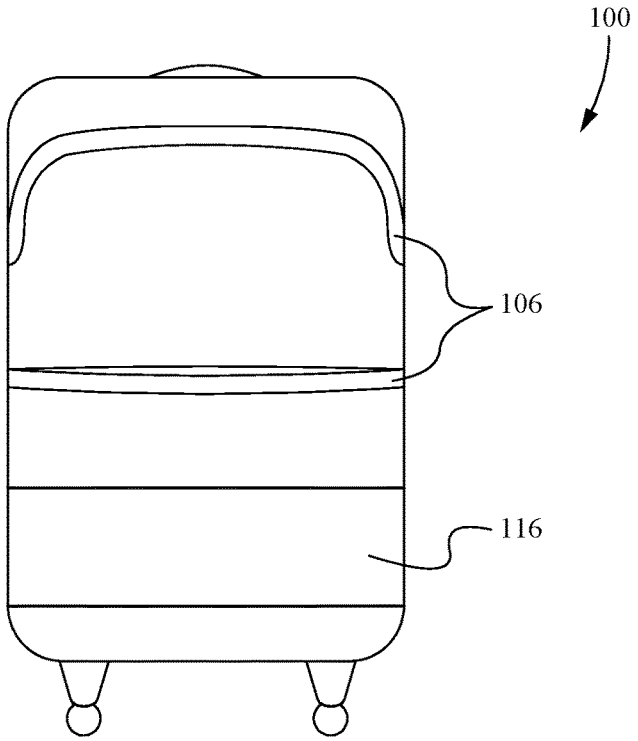
FIG. 2 illustrates a front view of a suitcase with an integrated garment bag according to some embodiments.

FIG. 2 illustrates a front view of a suitcase with an integrated garment bag according to some embodiments. The suitcase 100 includes one or more outside pockets 106 for storing items. The suitcase 100 also contains a drawer 116 for storing items such as shoes.

Figure 3:
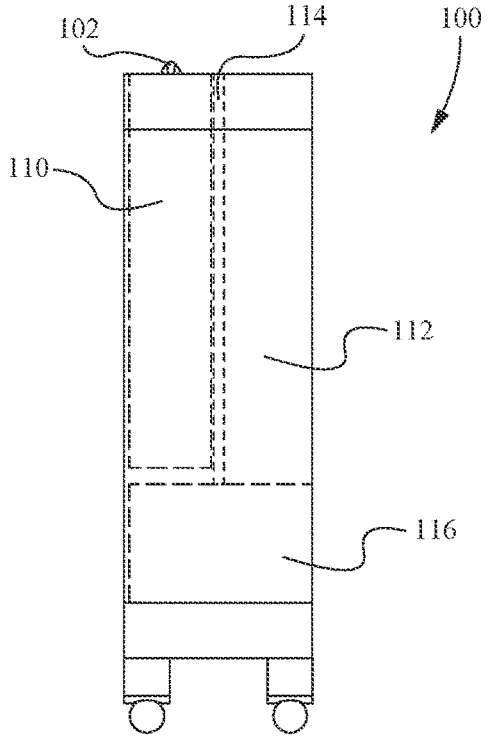
FIG. 3 illustrates a side view of a suitcase with an integrated garment bag according to some embodiments.

FIG. 3 illustrates a side view of a suitcase with an integrated garment bag according to some embodiments. The suitcase 100 includes a garment bag 110 and an empty space 112 which are separated by a partition 114. In some embodiments, a drawer 116 is contained at the bottom of the suitcase 100.

Figure 4:
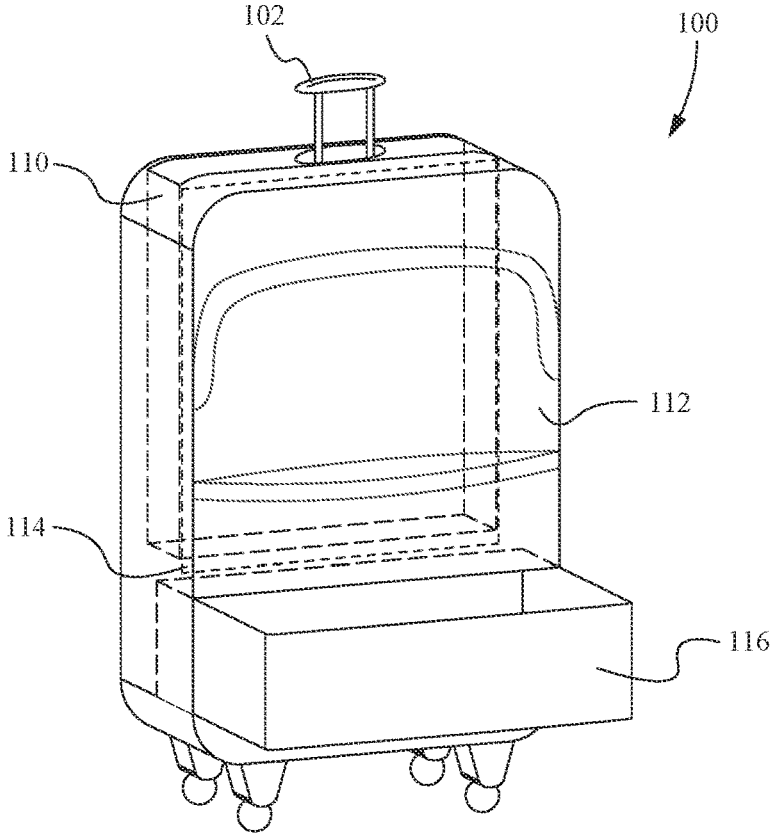
FIG. 4 illustrates a cross-section view of a suitcase with an integrated garment bag with a handle raised according to some embodiments.

FIG. 4 illustrates a cross-section view of a suitcase with an integrated garment bag with a handle raised according to some embodiments. The suitcase 100 includes a garment bag 110 and an empty space 112 which are separated by a partition 114. In an exemplary embodiment, the garment bag 110 is 5 inches deep and the empty space 112 is 5 inches deep. In some embodiments, the garment bag 110 and the empty space 112 are approximately equal depth, and in some embodiments, one is deeper than the other. The empty space 112 is configured to store items such as shorts, underwear, socks, t-shirts, pajamas and other items where wrinkling is not a concern. The garment bag 110 is configured to hold several suits, neckties, suspenders and/or other everyday attire for a casual traveler or business executive to be kept unwrinkled or minimally wrinkled. In some embodiments, the garment bag 110 is able to hold suits or other clothing on hangers or other devices to keep them wrinkle-free. In some embodiments, a drawer 116 is located at the bottom of the suitcase 100. In an exemplary embodiment, the drawer 116 is approximately 4 inches in height and is configured to store two pairs of shoes.

To access the garment bag 110, a user pulls on a handle 102 vertically. Once the handle 102 stops, the user is able to unzip the garment bag 110 to retrieve his garments. In some embodiments, the handle 102 is coupled to the garment bag 110 such that the garment bag 110 is able to be lifted substantially out of the suitcase 100. The garment bag 110 includes doors 118 (FIG. 5) such as suicide doors or French doors. On the inside of each door are places where a user is able to store several neckties, suspenders, cufflinks, handkerchiefs or other items. The doors 118 (FIG. 5) are able to open completely wide. In some embodiments, the suitcase 100 includes a locking mechanism 702 (FIG. 7) or receiving mechanism for receiving and/or locking the garment bag 110 within the suitcase 100.

In some embodiments to access the garment bag 110, the suitcase 100 contains a backdoor 800 (FIG. 8) which opens, revealing access to the garment bag 110.

Figure 5:
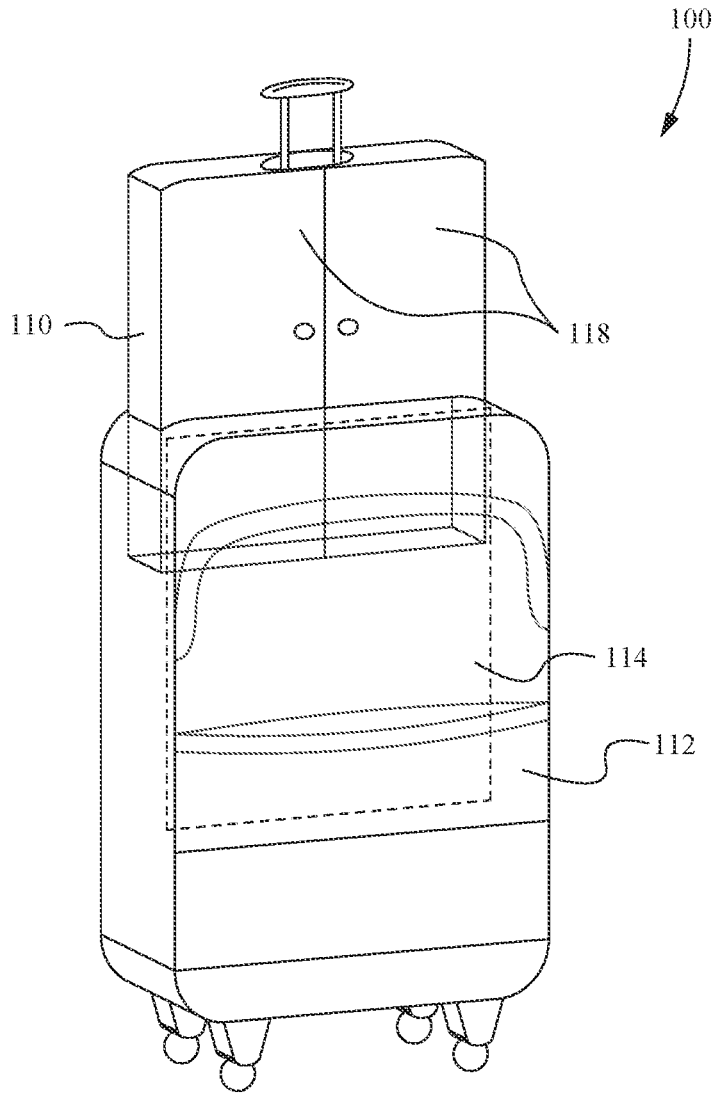
FIG. 5 illustrates a perspective view of a suitcase with an integrated garment bag where the garment bag is substantially lifted out of the suitcase according to some embodiments.

FIG. 5 illustrates a perspective view of a suitcase with an integrated garment bag where the garment bag is substantially lifted out of the suitcase according to some embodiments. As the user lifts the handle 102, the partition 114 as well as the garment bag 110 are lifted from the suitcase 100. Once the garment bag 110 is substantially lifted from the suitcase 100, the user is able to open the doors 118 and access the items contained within the garment bag 110. In some embodiments, the lifting is performed by a motor 700 (FIG. 7) or other automated mechanism where a user is able to press a button 710 (FIG. 7), use a remote control 704 (FIG. 7), use a smart phone or tablet 706 (FIG. 7), or other input device which causes the mechanism to automatically lift the garment bag 110 partially out of the suitcase 100.

Figure 6:
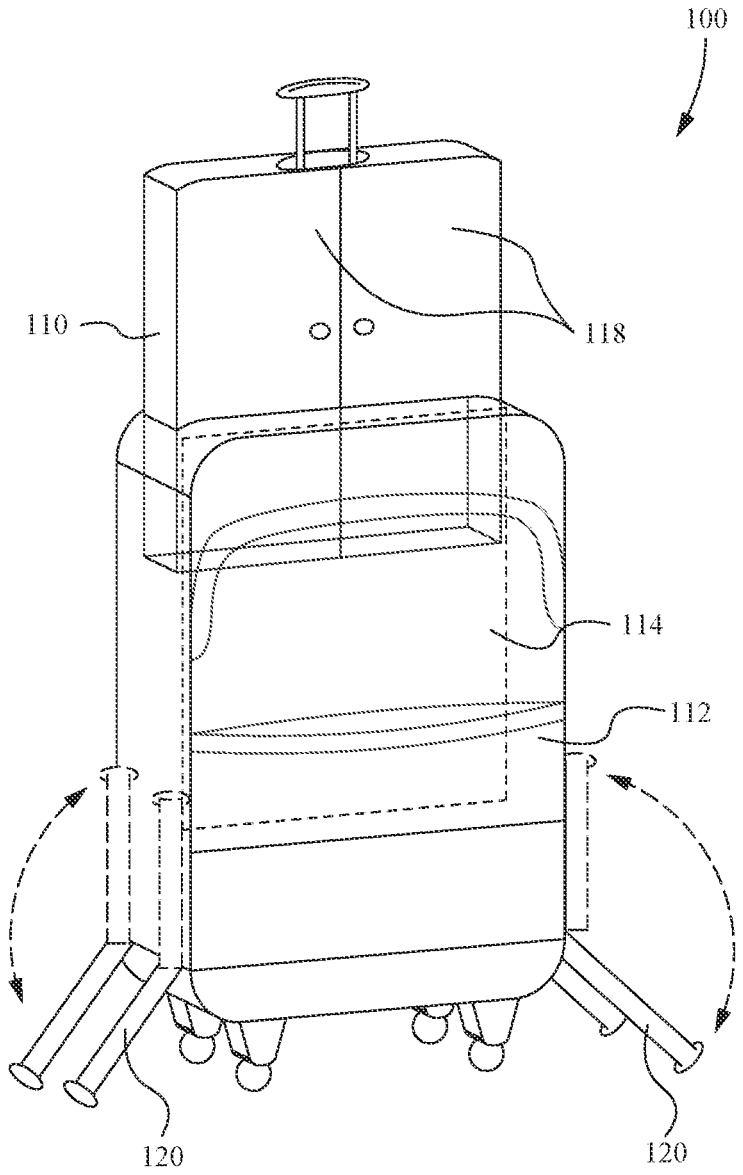
FIG. 6 illustrates a perspective view of a suitcase with an integrated garment bag where the garment bag is substantially lifted out of the suitcase with stabilization feet according to some embodiments.

FIG. 6 illustrates a perspective view of a suitcase with an integrated garment bag where the garment bag is substantially lifted out of the suitcase with stabilization feet according to some embodiments. As the user lifts the handle 102, the partition 114 as well as the garment bag 110 are lifted from the suitcase 100. Once the garment bag 110 is substantially lifted from the suitcase 100, the user is able to open the doors 118 and access the items contained within the garment bag 110. In some embodiments, the lifting is performed by a motor 700 (FIG. 7) or other automated mechanism where a user is able to press a button 710 (FIG. 7), use a remote control 704 (FIG. 7), use a smart phone or tablet 706 (FIG. 7) or other input device which causes the mechanism to automatically lift the garment bag 110 partially out of the suitcase 100. Additionally, the suitcase 100 includes releasable stabilization feet 120. The stabilization feet 120 are configured to be stored within the suitcase 100 when not in use, and to extend from the suitcase 100 when the feet 120 are in use. In some embodiments, the stabilization feet 120 are released when the garment bag 110 is fully extended. The stabilization feet 120 are positioned on all four corners of the suitcase 100 or other configurations. The stabilization feet 120 lock to generate a balanced suitcase 100 that will not fall over even if the ground is not level. In some embodiments, the stabilization feet 120 are telescoping or another implementation, so that some of the feet extend more than others to balance the suitcase 100 on uneven ground. In some embodiments, the stabilization feet 120 are configured to independently operate. For example, a user is able to pull the feet 120 down by hand, or a mechanized system is able to lower the feet 120 automatically. In some embodiments, the stabilization feet 120 are configured to operate in conjunction with the handle 102. For example, when a user pulls the handle 102 to an upper position, a mechanized system automatically lowers the feet 120. In another example, when a user pulls the handle 102, a component (e.g. a rod) coupled to the feet 120 pushes the feet 120 into an extended position. In some embodiments, the wheels 104 (FIG. 1) are extendable. In some embodiments, the stabilization feet 120 are able to rotate down from an up position to stabilize the suitcase.

Figure 7:
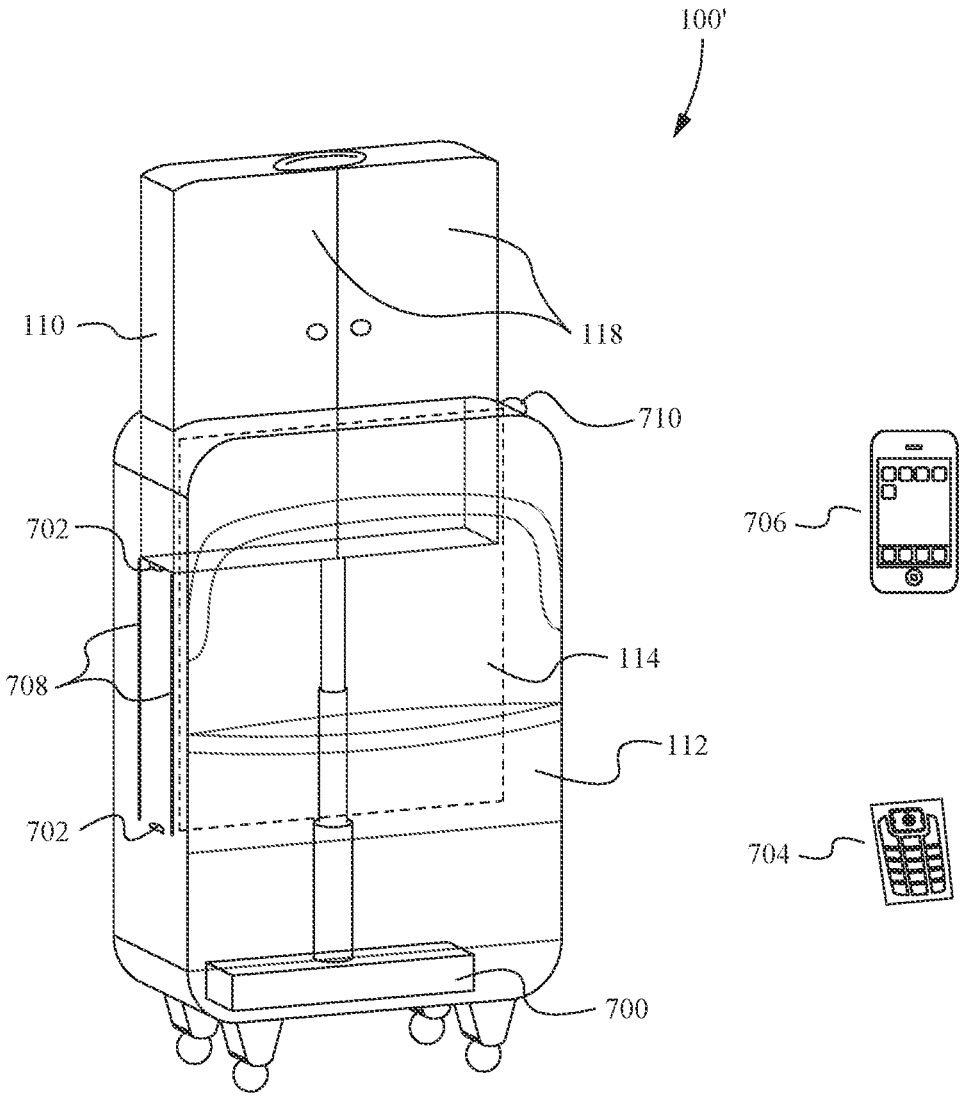
FIG. 7 illustrates a perspective view of a suitcase with an integrated garment bag where the garment bag is substantially lifted out of the suitcase with a motor according to some embodiments.

FIG. 7 illustrates a perspective view of a suitcase with an integrated garment bag where the garment bag is substantially lifted out of the suitcase with a motor according to some embodiments. The suitcase 100' includes a garment bag 110 with doors 118. The suitcase also includes a partition 114 and empty space 112 as described herein. A motor 700 is able to be used to automatically lift the garment bag 110 out of the suitcase 100'. The motor 700 is able to be configured and positioned anywhere in the suitcase 100' to utilize the suitcase 100' as described herein. For example, the motor 700 is positioned at the bottom of the suitcase and a telescoping arm extends and retracts to push the garment bag 110 out of and pull the garment bag 110 into the suitcase 100'. In some embodiments, the garment bag 110 is on tracks 708 within the suitcase 100'. In some embodiments, the tracks 708 are automated for moving the garment bag 110. The motor 700 or other automated system is able to be operated using a button 710, a remote control 704, a smart phone or tablet 706 (FIG. 7) or any other input device. In some embodiments, the garment bag 110 locks into the suitcase 100' using a lock 702. The lock 702 is able to be any locking or securing mechanism such as a clip-in structure or securing magnets which help to secure the garment bag 110 in place.

Figure 8:
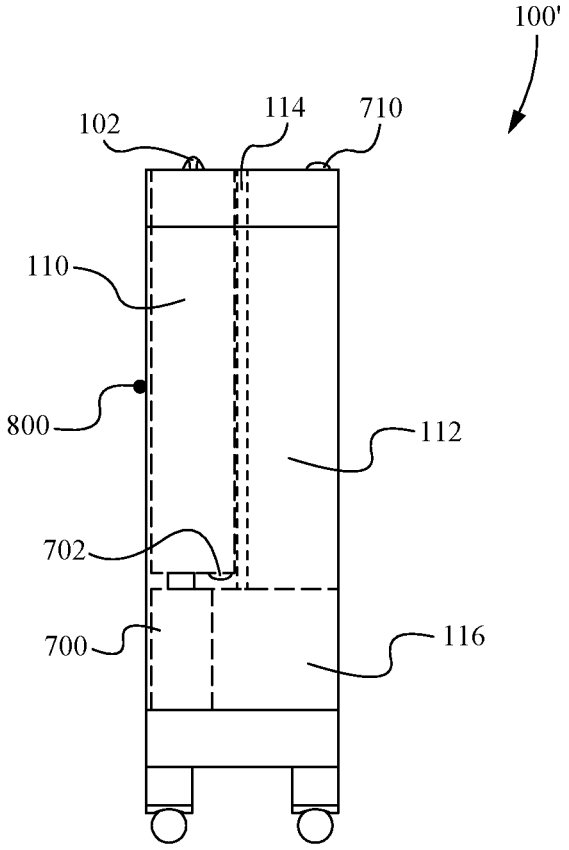
FIG. 8 illustrates a side view of a suitcase with an integrated garment bag according to some embodiments.

FIG. 8 illustrates a side view of a suitcase with an integrated garment bag according to some embodiments. The suitcase 100' includes a garment bag 110 and an empty space 112 which are separated by a partition 114. In some embodiments, a drawer 116 is contained at the bottom of the suitcase 100'. The suitcase 100' is able to include a motor 700, a lock 702 and button 710 as described herein. In some embodiments, the motor 700 is positioned at the back of the suitcase 100' behind the drawer 116. The suitcase 100' is also able to include a backdoor 800 for accessing the garment bag 110 while still in the suitcase 100'. Through the backdoor 800, a user is able to open the back side of the garment bag 110 and retrieve items in the garment bag 110 without removing the garment bag 110 from the suitcase 100'.

Figure 9:
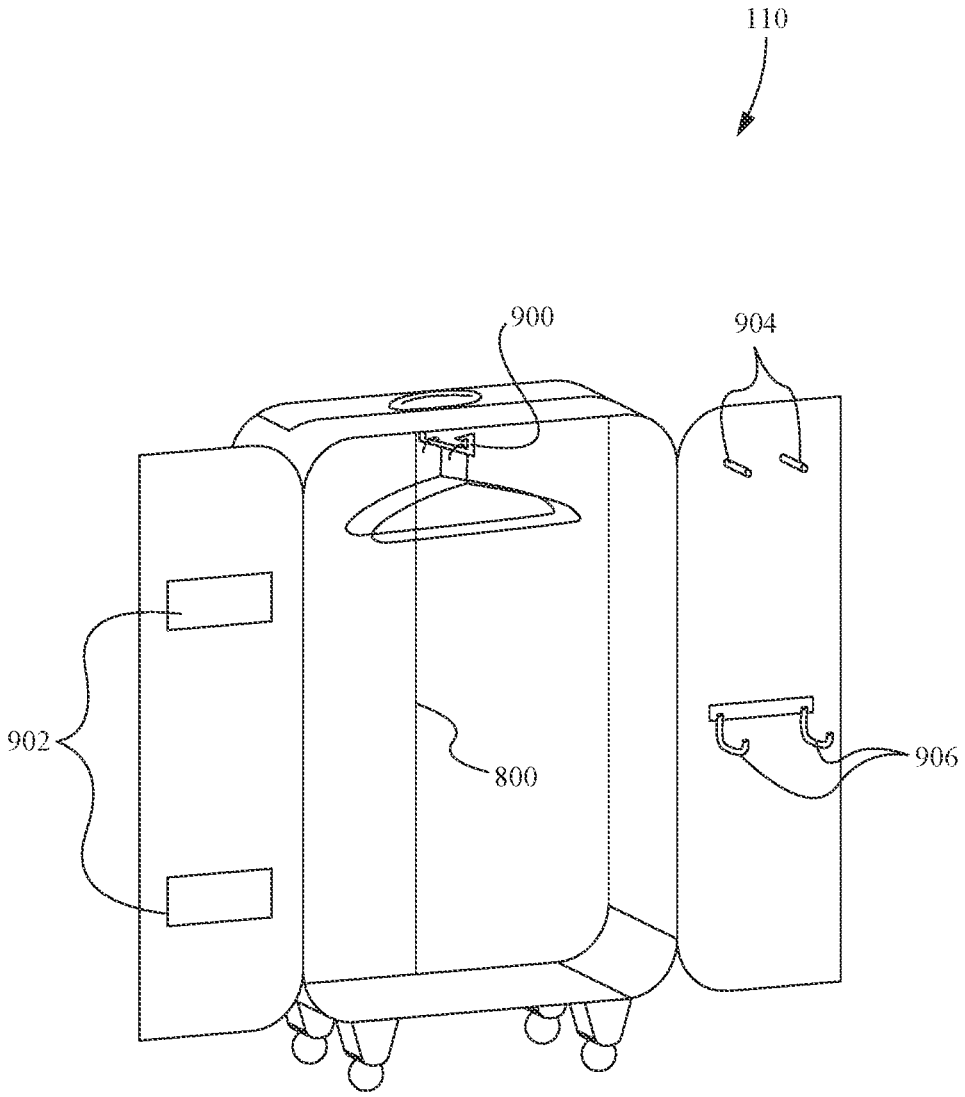
FIG. 9 illustrates a perspective view of a garment bag according to some embodiments.

FIG. 9 illustrates a perspective view of a garment bag according to some embodiments. The garment bag 110 includes a hanger holder 900 configured for receiving hangers from which garments hang. The hanger holder 900 is able to be any configuration such as a piece of rubber with holes to receive hangers. The garment bag 110 also includes pockets 902, knobs 904, hooks 906, or any other mechanisms on the doors or the inside back of the garment bag 110 for storing garments such as neckties, suspenders, cufflinks, handkerchiefs or other items. The backdoor 800 of the garment bag 110 is also shown.

Figure 10:
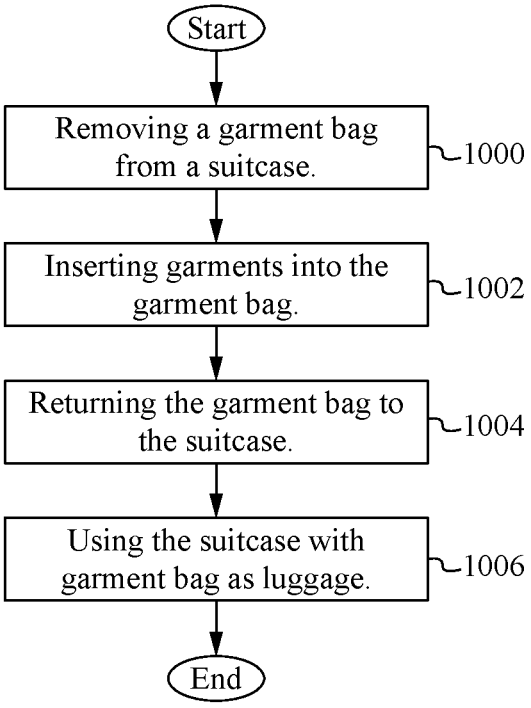
FIG. 10 illustrates a flowchart of a method of using the suitcase with an integrated garment bag according to some embodiments.

FIG. 10 illustrates a flowchart of a method of using the suitcase with an integrated garment bag according to some embodiments. In the step 1000, the garment bag is lifted and/or removed. The lifting is able to be performed manually using a handle or automatically using a motor or other device. In the step 1002, garments are placed within the garment bag. In the step 1004, the garment bag is returned within the suitcase. Returning is able to be manually or automatically performed. In the step 1006, the suitcase with integrated garment bag is utilized similarly to other luggage such as rolled through the airport, carried, and placed for storage. In some embodiments, the order of the steps is modified. In some embodiments, there are more or fewer steps implemented.

To utilize the suitcase with an integrated garment bag, a user places items within the empty space. The user also places items in the garment bag. The user is then able to transport the items within the suitcase while maintaining the condition of the items in the garment bag. When the user chooses to remove the items in the garment bag, the user pulls the handle of the suitcase which makes the garment bag accessible. Doors of the garment bag open, and the items within the garment bag are able to be removed by the user.

In operation, the suitcase with an integrated garment bag enables a user to keep items separate, for example, to keep garments from wrinkling.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. A suitcase comprising:

a. a frame comprising a top, a bottom, a front and a rear;

b. a partition within the frame separating the frame into a plurality of chambers;

c. a garment bag stored in a chamber of the plurality of chambers, wherein the garment bag is stored in a vertical orientation, the garment bag comprising doors through which an interior of the garment bag is accessed; and d. a motorized component coupled to the garment bag for moving the garment bag.

2. The suitcase of claim 1 further comprising a handle coupled to the garment bag for lifting the garment bag substantially out of the frame.

3. The suitcase of claim 1 further comprising a drawer contained within the frame at the bottom of the frame.

4. The suitcase of claim 1 further comprising extendable stabilization feet.

5. The suitcase of claim 1 wherein the motorized component includes a telescoping arm for raising and lowering the garment bag.

6. The suitcase of claim 1 further comprising a mobile device for controlling the motorized component.

7. The suitcase of claim 6 wherein the mobile device is a remote control or a smart phone.

8. The suitcase of claim 1 further comprising tracks for moving the garment bag.

9. The suitcase of claim 1 further comprising a backdoor within the frame for accessing the garment bag while the garment bag is still within the frame.

10. The suitcase of claim 1 further comprising a locking mechanism for locking the garment bag within the frame.

11. A method of utilizing a suitcase with an integrated garment bag comprising doors through which an interior of the garment bag is accessed, the method comprising:

a. removing the garment bag from the suitcase using a motorized component affected by a wireless device;

b. inserting garments into the interior of the garment bag through the doors;

c. returning the garment bag to the suitcase using the motorized component affected by the wireless device; and d. using the suitcase as luggage.

12. A suitcase comprising:

a. a frame comprising a top, a bottom, a front and a rear;

b. a partition within the frame separating the frame into a plurality of chambers, wherein a first chamber of the plurality of chambers is configured for storing items;

c. a garment bag stored in a second chamber of the plurality of chambers, wherein the garment bag is stored in a vertical orientation and configured for storing garments to minimize the wrinkling of the garments;

d. a locking mechanism located within the frame configured for locking the garment bag within the frame;

e. tracks located within the frame on which the garment bag is movable;

f. a motorized component including a telescoping arm configured for raising and lowering the garment bag;

g. a drawer contained within the frame at the bottom of the frame;

h. a plurality of extendable stabilization feet coupled to the frame; and i. a backdoor within the frame for accessing the garment bag while the garment bag is still within the frame.

13. The suitcase of claim 12 further comprising a handle coupled to the garment bag for lifting the garment bag substantially out of the frame.

14. The suitcase of claim 12 further comprising a mobile device for controlling the motorized component.

15. The suitcase of claim 12 wherein the mobile device is a remote control or a smart phone.

16. The suitcase of claim 12 further comprising a locking mechanism for locking the garment bag within the frame.

* * * * *